US006392537B1

(12) United States Patent
Tazumi et al.

(10) Patent No.: US 6,392,537 B1
(45) Date of Patent: May 21, 2002

(54) REMOTE MONITORING SYSTEM FOR AUTOMATIC DOOR SYSTEMS

(75) Inventors: Soichi Tazumi; Koji Kakuyama, both of Hyogo-ken (JP)

(73) Assignee: Nabco Limited, Kobe (JP)

( * ) Notice: Subject to any disclaimer, the term of this patent is extended or adjusted under 35 U.S.C. 154(b) by 0 days.

(21) Appl. No.: 09/258,969

(22) Filed: Feb. 26, 1999

(30) Foreign Application Priority Data

Feb. 27, 1998 (JP) ..... 10-064210

(51) Int. Cl.[7] ..... G08B 29/00

(52) U.S. Cl. ..... 340/507; 340/506; 340/825.06; 49/31; 187/316

(58) Field of Search ..... 340/506, 507, 340/514, 825.06, 286.02; 49/31, 30, 25, 370; 187/316, 391, 393

(56) References Cited

U.S. PATENT DOCUMENTS 4,604,826 A * 8/1986 Sorber ..... 49/31
5,127,190 A * 7/1992 Hein et al. ..... 49/31
5,400,246 A * 3/1995 Wilson et al. ..... 340/825.06 X
5,760,350 A * 6/1998 Pepin et al. ..... 187/316

FOREIGN PATENT DOCUMENTS

JP 63-83384 6/1988

* cited by examiner

*Primary Examiner*—Daryl Pope
(74) *Attorney, Agent, or Firm*—Duane, Morris & Heckscher LLP

(57) ABSTRACT

A maintenance station monitors and maintains a plurality of automatic door systems at remote locations. Each door system includes a control unit for controlling the operation of an automatic door, and a self-diagnosing arrangement which operates in conjunction with the control operation of the control unit, to inspect the automatic door system for malfunctioning or broken part of the door system. When a failure is found in the automatic door system, the self-diagnosing arrangement of that door system sends information identifying that door system and information identifying the malfunctioning or broken part to the maintenance station via modems and telephones.

9 Claims, 9 Drawing Sheets

| Code Type | Content |
|---|---|
| ID Code | Identification of Door System |
| Failure Code | Identification of Failure |
| State Code | Operating State |

REMOTE MONITORING SYSTEM FOR AUTOMATIC DOOR SYSTEMS

This application is based on Japanese Patent Application No. HEI 10-64210 filed on Feb. 27, 1998, which is incorporated herein by reference.

This invention relates to a system for monitoring automatic door systems at remote locations.

BACKGROUND OF THE INVENTION

An automatic door system includes a motor for driving a door to open and close, and a sensor for detecting whether or not any object is present near the door. Also, it includes a controller for causing the door to be opened when the sensor senses an object and for causing the door to be closed when the sensor senses no object. If the automatic door fails, a sales agent may be called to repair it. The sales agent must find a maintenance man or maintenance women (hereinafter referred to simply as maintenance man) available at that time to send him to inspect the automatic door system. It may sometimes need a relatively long time for the sales agent to find out an available maintenance man and send him to the location where the door system is installed. The maintenance man must inspect parts of the automatic door system one by one to find malfunctioning parts. To locate malfunctioning parts also takes a relatively long time.

Japanese Unexamined UM Publication No. SHO 63-83384 published on Jun. 1, 1988 discloses a system for inspecting an automatic door system to find failures and, if failures are found, notifying it to a service agent.

The system disclosed in the Japanese UM publication notifies a service agent of some abnormal states of the automatic door system, such as a state in which the door is continuously kept closed or opened. Since there are various causes for which the door is continuously opened or closed, the service agent cannot determine, from the information obtained by the system, which parts of the door system fail. Accordingly, it may take a relatively long time for a maintenance man, who is sent to repair the door system, to locate the malfunctioning part. Thus, the system of the Japanese UM publication does not much facilitate prompt repair of the automatic door system.

When an automatic door system is installed, the door opening and closing speeds and other operating parameters are set. Sometimes, the owner of the door system may request that the door opening and closing speeds set when the door is installed be changed. In such a case, too, a maintenance man is sent to the location where the door system is installed. Sending a maintenance man for making such change makes prompt maintenance impossible.

An object of the present invention is to provide a system for monitoring automatic door systems from a remote location, which can facilitate prompt repairs of the automatic door system and prompt modification of parameters of the door system.

SUMMARY OF THE INVENTION

An automatic door remote monitoring system according to the present invention is adapted to monitor a plurality of automatic door systems from a remote location, e.g. a maintenance station which monitors and maintains such plural automatic door systems. Each door system has a control unit which includes a controller and self-diagnosing means. The controller controls the operation of the door system associated therewith, and the self-diagnosing means operates, in conjunction with the controlling of the door by the controller, to inspect the door system to find out a malfunctioning or broken part thereof. When any one of the door systems fails, the self-diagnosing means of that door system sends to the maintenance station, through a communications system, failure information including door system part identifying information indicating a malfunctioning or broken part of that door system (hereinafter referred to simply as door system part identifying information). Also, the failure information includes door system identifying information identifying the door system to which each self-diagnosing means belongs.

When any of the automatic door systems fails, the self-diagnosing means of the failing door system sends the above-described failure information including door system part identifying information and door system identifying information to the maintenance station through the communications system. Thus, a person at the maintenance station can determine and advise a maintenance man which one of the automatic door systems is failing and which a part of that door system is malfunctioning or broken, at substantially the same time that part fails. Since a part which has failed has been determined, the maintenance man can prepare for the expected necessary repairs before he leaves the maintenance station, and, therefore, repairs of the door system can be done in a relatively short time.

In addition to the above-described door system part identifying information and door system identifying information, the failure information may include information of door operation relating to the diagnosis made by the self-diagnosing means. The door operation information is such information that the maintenance man can determine how the door system should be repaired, by studying the information together with the above-described door system part and door system identifying information. For example, the door operation information may be information about the door position where the door has stopped, parameter information about a door operation parameter, such as a door opening speed and a door closing speed, and maintenance information. The maintenance information may include information indicating how many times the door has been opened and closed before the failure occurred, and how many times the door system has been stopped due to external causes.

Since the self-diagnosing means sends, in addition to the door system part identifying information and the door system identifying information, the door operation information to the maintenance station, the maintenance man can know what should be repaired and how it should be repaired before he leaves the maintenance station. Accordingly, he can make enough preparations for the expected repairs and, therefore, promptly remove the failure.

The above-described failure information may be sent to a plurality of maintenance stations through a communications system. In such a case, failure information relating to failure of a door system received by one of the maintenance stations may be forwarded to another maintenance station. The failure information which may be forwarded to another maintenance station may include, for example, the door system identifying information indicating which one of the door systems fails, the door system part identifying information indicating which part of the malfunctioning door system fails, and the door operation information.

It may occur that no maintenance men are available at that maintenance station at the time when failure of one door system is notified to the maintenance station. For example, door failure information may be sent at night when all maintenance men have been home. If such information is sent to a maintenance station in daytime, it may happen that no maintenance men are available at that time. Even in such a case, a maintenance man must be sent to the door system from which the information was sent. Accordingly, the information is forwarded from the station where the information has been received but no maintenance men are available, to a maintenance station where a maintenance man is available, so that the door system can be repaired soon.

The self-diagnosing means of a door system which has failed may fail to communicate with one of a plurality of maintenance stations. In such a case, it may send the door failure information to other one of the maintenance stations.

The communications system may use, for example, public telephone lines. If the telephone line to one maintenance station is busy, the information cannot reach that station. Then, the self-diagnosing means of the malfunctioning door system sends the door failure information to another maintenance station, from which a maintenance man can be sent to the door system for repairing it.

The door operation information relating to the failure detected by the self-diagnosing means may be door-position indicating information indicating the door position where the detected failure has occurred.

If the door operation information is door-position indicating information, a maintenance man can know, even when he is still at the maintenance station, at which position the door has stopped, the fully closed position, the fully open position or an intermediate position between the fully closed and open positions. Then, the maintenance man can send a direction to a door caretaker, who takes care of that door system, to, for example, open the door by hand if the door is closed or partly open, so that passengers can pass through the door smoothly. If the door is fully opened or partly closed, the door caretaker can be directed to manually close the door to thereby prevent burglary at night.

Depending on the malfunctioning or broken part, the self-diagnosing means may make the control unit stop the door operation or change the door operating parameter, in addition to sending door failure information to a maintenance station. The door operating parameter may be, for example, a door moving speed.

Depending on the malfunctioning part, the automatic door system should be stopped. If the door is not stopped, the door system may become irreparable. In some cases, failure of some part may not require the automatic door system to be stopped. But the failure may be of such a nature that, if the door system is continuously operated with the current door operating parameter, the door system may become irreparable. For example, if the automatic door is opened and closed repetitively, without repairing some malfunctioning part, the motor which drives the door to open and close may be overheated and burnt. To avoid such situation, the self-diagnosing means sends information indicating the malfunctioning part and, in addition, causes the door to stop or modifies some operating parameter(s). This may delay deterioration of the door.

According to another aspect of the present invention, an automatic door monitoring system is adapted to monitor a plurality of automatic door systems at remote locations. Each of the door systems includes a control unit. The control unit includes a controller for controlling the respective doors, and self-diagnosing means, which operates, in conjunction with the control being provided by the controller, to detect a malfunctioning or broken part. When the automatic door system operates abnormally, the self-diagnosing means of the door system sends door system part identifying information to a maintenance station through a communications system, and then, the maintenance station sends a command to change the manner of operation of the door to the control unit of the door system to which the self-diagnosing means belongs.

The command for changing the manner of operation of the automatic door may be a command to lower the moving speed of the automatic door, a command to make the door fully opened or a command to make the door fully closed.

As described above, if the door system continues to operate, with its broken or malfunctioning part not repaired, the door system may become irreparable, depending on the broken part. In order to avoid it, a maintenance station which has received failure information sends a command to change the manner of operation of the door to the door system which has sent the failure information to that maintenance station. In response to the command, the manner of operation of the door of the malfunctioning door system is changed so that the failure cannot be worsened.

Lowering the door moving speed can prevent overheat and, hence, burned-out of the motor. If the door is brought to the fully opened or closed position, it is kept in that position or, in other words, it is kept unmoving, and, therefore, the failure does not worsen. Further, people approaching the door can know that the door is out of order since the door is kept open or closed.

An automatic door remote monitoring system according to another aspect of the invention is adapted to monitor a plurality of automatic door systems at remote locations. In accordance with instructions given by the door caretaker of an automatic door system, a maintenance station sends a command to a control unit of an automatic door of the automatic door system to change an operating parameter of the door.

When an automatic door system is installed, the operating parameters, such as the door opening and closing speed, are usually set by a maintenance man. However, the owner or caretaker of the door system may wants to change the set operating parameters later, considering the number of passengers and other factors. In such a case, the door owner can order a maintenance station to send a command to change a door operating parameter. Thus, the maintenance of the door system can be made promptly without need for sending a maintenance man to the location where the door system is installed.

In addition to the door operating parameter changing command, a command to cause the door to operate temporarily in a predetermined special manner may be sent. Seeing the door operate in the predetermined manner, the door owner can know that the required door operating parameter has been changed.

When the control unit of the door system receives the command to change the door operating parameter, it causes the door to temporarily operate in the predetermined special manner. The command for the predetermined special manner of the door operation may be sent from a maintenance station or may be stored in the automatic door system itself.

The predetermined special operation of the door takes place temporarily after the command to change the door operating parameter is received. Therefore, the reception of the door operating parameter changing command can be confirmed in the automatic door system side, and it can be understood that the change of the operating parameter of the door will be made after the predetermined special operation of the door takes place.

Each of the automatic door systems may include an object sensor for sensing an object approaching the door. The control unit changes the door operating parameter when no object is being sensed by the object sensor. In other words, the door operating parameter is changed when no passenger is near the door, whereby collision of the door with a passenger can be avoided.

DETAILED DESCRIPTION OF EMBODIMENTS

Figure 1:
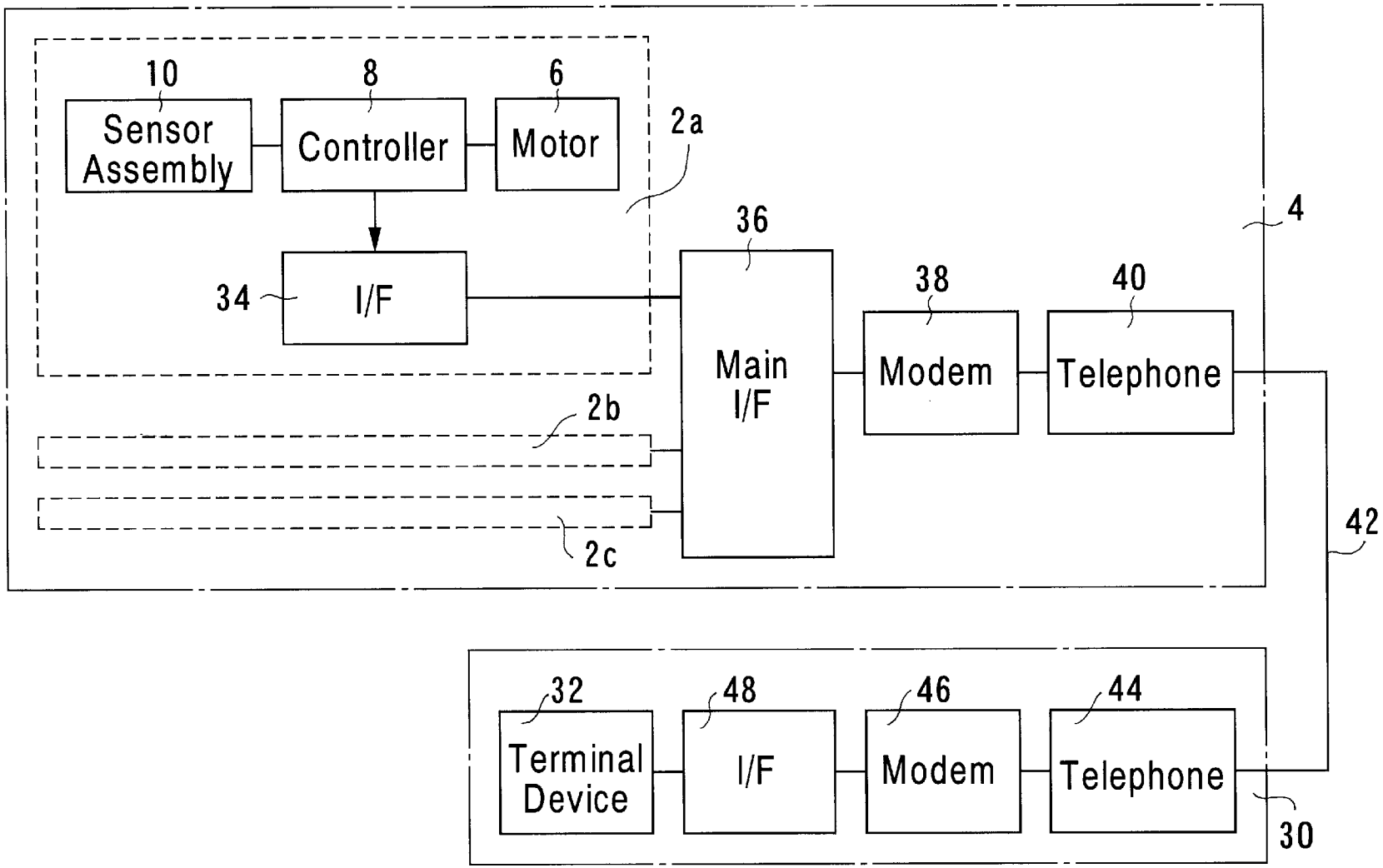
FIG. 1 is a block diagram of a monitoring system for monitoring automatic door systems at remote locations according to a first embodiment of the present invention.

As shown in FIG. 1, an automatic door remote monitoring system according to a first embodiment of the present invention monitors a plurality, e.g. three, of automatic door systems 2*a,* 2*b* and 2*c* installed at locations remote from the monitoring system. The door systems 2*a,* 2*b* and 2*c* may be installed at different locations in a building 4.

Each of the automatic door systems 2*a,* 2*b* and 2*c* has an automatic door or door panel which selectively opens and closes a doorway formed in a wall of the building 4. Since all of the door systems 2*a,* 2*b* and 2*c* may have the same structure, only the automatic door system 2*a* is described hereinafter, but the same description is applicable to the remaining door systems.

The door system 2*a* also includes a motor 6 for driving the door through a transmission mechanism (not shown) including a belt, and a control unit 8 for controlling the motor 6. The motor 6 may be a three-phase brushless motor.

The automatic door system 2*a* also has an assembly of sensors 10 for sensing an object, e.g. a human, in an area near the door system 2*a*. In the normal state, the door is closed, i.e. it is in the fully closed position. If any one of a plurality of sensors of the sensor assembly 10 senses an object, the control unit 8 causes the motor 6 to rotate in a predetermined direction to thereby open the door, and when none of the sensors becomes to sense the object, the control unit 8 causes the motor 6 to rotate in the opposite direction to thereby close the door. Each of the sensors may be an optical sensor which includes a light-emitter and a light-receiver.

Figure 2:
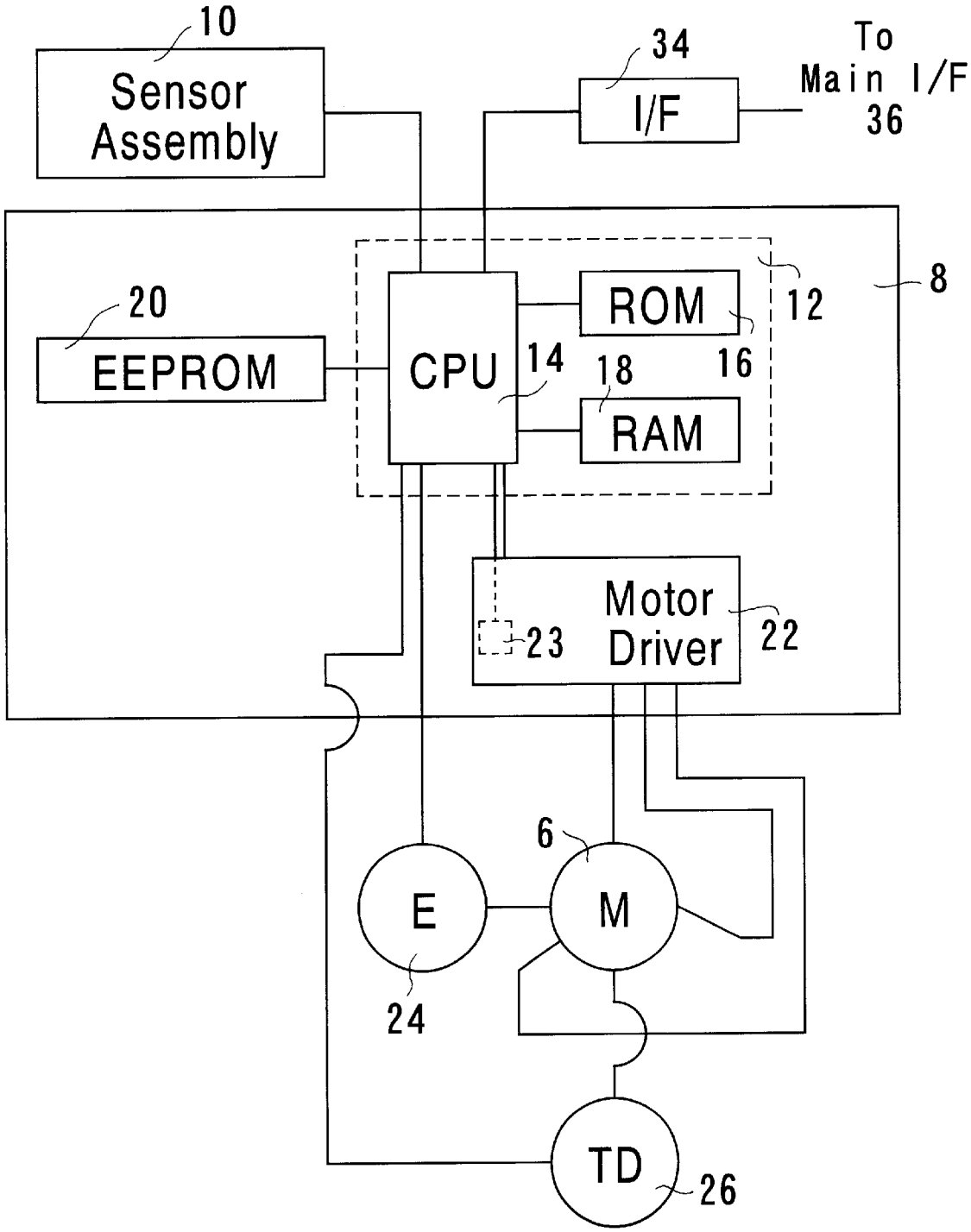
FIG. 2 is a detailed block diagram of a control unit and peripheral devices shown in FIG. 1.

As is seen from FIG. 2, the control unit 8 includes a microprocessor unit (MPU) 12, which, in turn, includes a CPU 14, a non-volatile memory, e.g. ROM 16, and a volatile memory, e.g. RAM 18. The control unit 8 also includes a writable, non-volatile memory, e.g. EEPROM 20, and a motor driver 22. The ROM 16, the RAM 18, the EEPROM 20 and the motor driver 22 are all connected to the CPU 14.

The motor driver 22 includes a motor current detector 23 for detecting current flowing through the motor 6 and producing a current representative signal representative of the detected current. The current representative signal is applied to the CPU 14. A motor rotation detector, e.g. encoder (E) 24, is disposed in association with the motor 6, for detecting the rotation rate of the motor 6 and generating a rotation rate representative signal, which is applied to the CPU 14. A temperature detector (TD) 26 detects the temperature of the motor 6 and generates an overheat signal when the temperature of the motor 6 exceeds a predetermined temperature.

In accordance with programs stored in the ROM 16, the CPU 14 controls the door, self-diagnoses or inspects the automatic door system for failure and communicates with a maintenance station, and, in order to temporarily store data to be used therefor, the RAM 18 is used. The EEPROM 20 has stored therein various operating parameters and data to be used in inspecting the automatic door system.

The motor driver 22 causes the motor 6 to rotate in the direction and at the rotation rate as instructed by the CPU 14. The output of the encoder 24 associated with the motor 6 is applied to the CPU 14, which is used to feedback control the motor 6 and to detect the current position of the door.

The CPU 14 inspects the door system, i.e. makes self-diagnosis, in accordance with programs stored in the ROM 16. The CPU 14 inspects the door system for failures, such as failures in the EEPROM 20, the ROM 16 and the RAM 18, breakage of the belt, disconnection of lines interconnecting the encoder 24 and the CPU 24, abnormality of the motor current, failure of any one of the sensors in the sensor assembly 10, abnormality of the magnetism of the motor 6, and overheating of the motor 6. An example of the manner of conducting the inspection is disclosed in Unexamined Japanese Patent Publication No. HEI 10-46918 published on Feb. 17, 1998, which corresponds to U.S. patent application Ser. No. 08/857,035 entitled "AUTOMATIC DOOR SYSTEM WITH SELF-DIAGNOSING FUNCTION" filed on May 15, 1997 by H. Kanki and N. Taguchi and assigned to the same assignee as the present application, which is incorporated herein by reference. The inspection of the automatic door system may be done in a way different from the one disclosed in this U.S. patent application.

The inspection of the EEPROM 20, the ROM 16 and the RAM 18 is carried out by writing and reading data into and from them and determining whether written data can be correctly read out. Whether or not the motor current is normal can be determined from the output of the motor current detector 23. Whether or not the motor 6 is overheated is determined from the output of the temperature detector 26. The breakage of the motor belt, the disconnection of the encoder lines and the magnetic force abnormality can be known from the output of the encoder 24.

Each sensor in the sensor assembly 10 includes also a CPU, a ROM and a RAM, and the CPU executes a program to inspect the sensor for failure. The result of inspection is sent to the CPU 14.

When the CPU 14 judges, in accordance with the result of the self-diagnosis of the door system, that some part fails to operate or malfunctions, the CPU 14 transmits the result of the self-diagnosis to a terminal device 32 at a maintenance station 30 shown in FIG. 1. The maintenance station may be, for example, a sales company that sold the automatic door systems 2*a*–2*c*.

For that purpose, the door system has an interface circuit (I/F) 34. The interface circuits 34 of the door systems 2*a*–2*c* are connected to a main interface circuit (I/F) 36, which, in turn, is connected to a modem 38. The modem 38 is connected to a telephone set 40. The telephone 40 can communicate with a telephone set 44 at the maintenance station 30 via a public telephone line.

The telephone set 44 at the maintenance station 30 is connected to a modem 46, which, in turn, is connected to the terminal device 32 through an interface circuit (I/F) 48.

Thus, the control unit 8 is capable of communicating with the terminal device 32 through a communications system including the interface circuits 34 and 48, the main interface circuit 36, the modems 38 and 46, the telephone sets 40 and 44 and the public telephone line 42.

The terminal device 32 may have a structure similar to the control unit 8 and include a CPU, a ROM, a RAM etc., but it does not self-diagnose or control a door.

Figure 3:
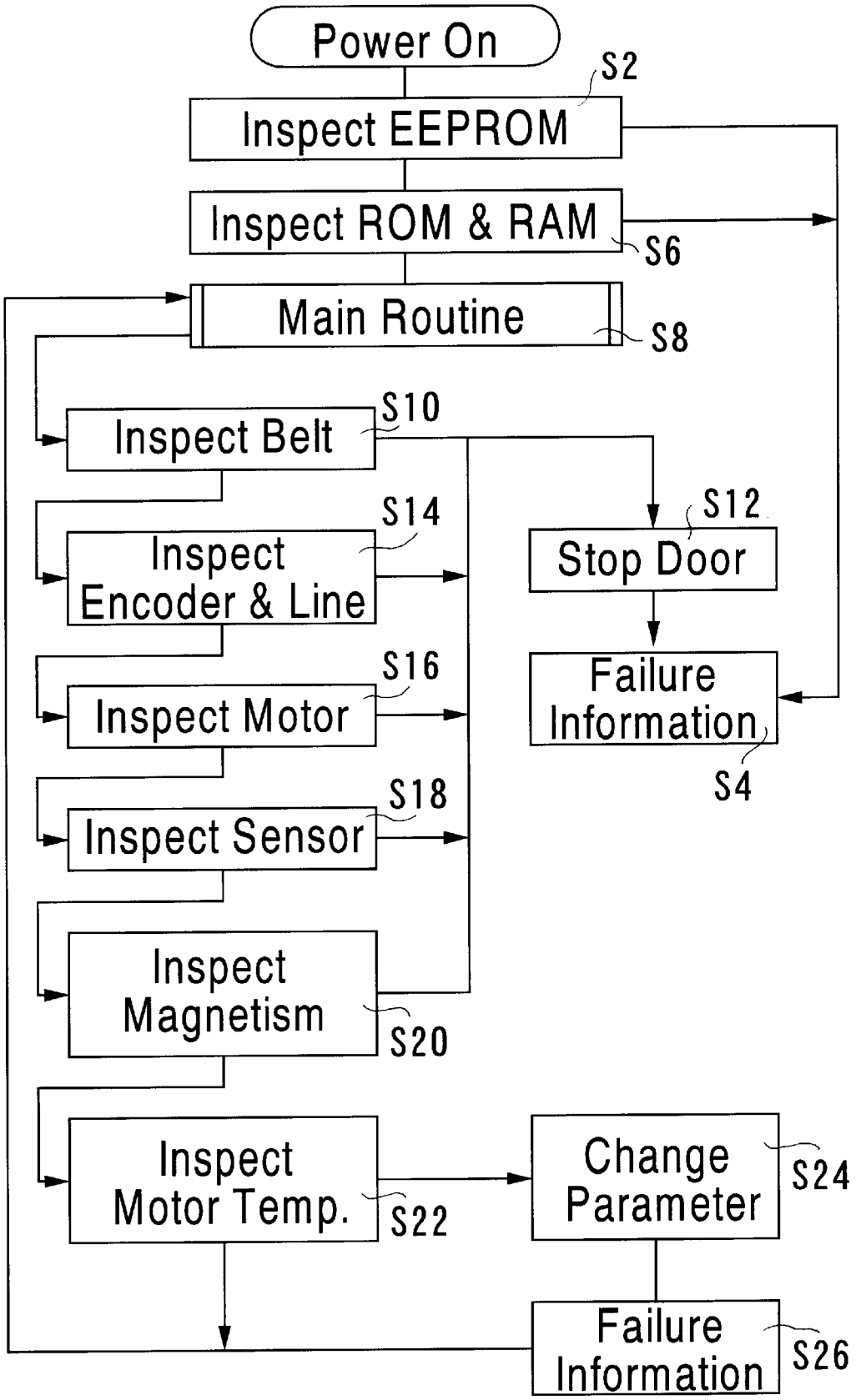
FIG. 3 is a flow chart showing the operation of the automatic door remote monitoring system.

FIG. 3 shows, in the form of a flow chart, a program executed by the CPU 14 of the control unit 8 of the automatic door system 2*a*.

When the door system 2*a* is powered on, the CPU 14 inspects the EEPROM 20 for failure (Step S2). If it is judged that the EEPROM 20 fails or malfunctioning, failure information is transmitted as will be described later (Step S4).

On the other hand, if it is judged that the EEPROM 20 is operating normally, the ROM 16 and the RAM 18 are inspected for failure (STEP S6). If it is judged that the RAM 18 is not operating properly, failure information is transmitted (STEP S4).

If the RAM 18 is judged to have no failure, the ROM 16 is inspected. If it is judged that the ROM 16 is not operating properly, failure information is transmitted (Step S4).

If the EEPROM 20, the RAM 18 and the ROM 16 have been judged to be operating properly, a main routine is executed (Step S8). In the main routine, commands are sent to the motor driver 22 to open the door when a sensor in the sensor assembly 10 detects an object, and to close the door when the object goes out of the sensing area of the sensor assembly and, therefore, is no longer detectable.

After the main routine is executed, the belt is inspected for breakage of the belt (Step S10). If it is judged that the belt is broken, a command is sent to the motor driver 22 to stop the operation of the door (Step S12), and the processing advances to Step S4 in which failure information is transmitted. The door is stopped because, if the motor 6 continues to rotate with the belt broken, it may also be damaged. The door is stopped for the same reason when another failure discussed later is detected.

If, on the other hand, it is judged that the belt is not broken, the encoder 24 and the line led from the encoder 24 are inspected for any defects therein (Step S14). If the encoder 24 or the line from it contains a failure, Step S12 and Step S4 are executed to make the door stop moving and to send failure information.

If, on the other hand, it is judged that both the encoder 24 and the line therefrom contain no failure, the current flowing in the motor 6 is inspected (Step S16). If the motor current is judged abnormal, the door is stopped (Step S12) and failure information is transmitted (Step S4).

If the motor current is judged normal, the processing advances to Step S18 where the sensors are inspected. In this Step S18, it is judged if any sensor in the sensor assembly 10 is sending a failure-indicative signal. If the failure-indicative signal is sent, Steps S12 and S4 are executed.

If no failure-indicative signal is sent from any of the sensors, the magnetism of the motor 6 is inspected next (Step S20).

If the magnetic property of the motor 6 is judged abnormal, Steps S12 and S4 are executed. If the magnetism of the motor 6 is judged normal, the temperature of the motor 6 is inspected (Step S22).

Each time the door opens or closes, current flows through the motor 6, so that the motor 6 generates heat. If the motor 6 is operating normally, the temperature of the motor does not exceed a given temperature. As stated previously, if the temperature of the motor 6 exceeds the given temperature, an overheat signal is developed by the temperature detector 26. If the overheat signal is being generated, the CPU 14 judges that the motor 6 is malfunctioning. If the overheat signal is not generated, the CPU 14 judges that the motor 6 is operating normally.

If the motor 6 is judged to be normally operating, the processing returns to Step S8, and the automatic door control and the inspection stated above are performed.

On the other hand, if it is judged that there is some fault in the motor 6, a parameter is changed (Step S24). For example, a parameter which determines the door moving speed is changed to lower the door moving speed from the preset speed so that the loading on the motor 6 can be reduced. The reduction of loading on the motor 6 makes it possible to open and close the automatic door, while preventing such a fatal failure of the motor 6 that may make the door unmovable. After that, failure information is transmitted (Step S26). It should be noted that the processing of Step S26 is different from the processing of Step S4, as will be described later.

Figure 4A:
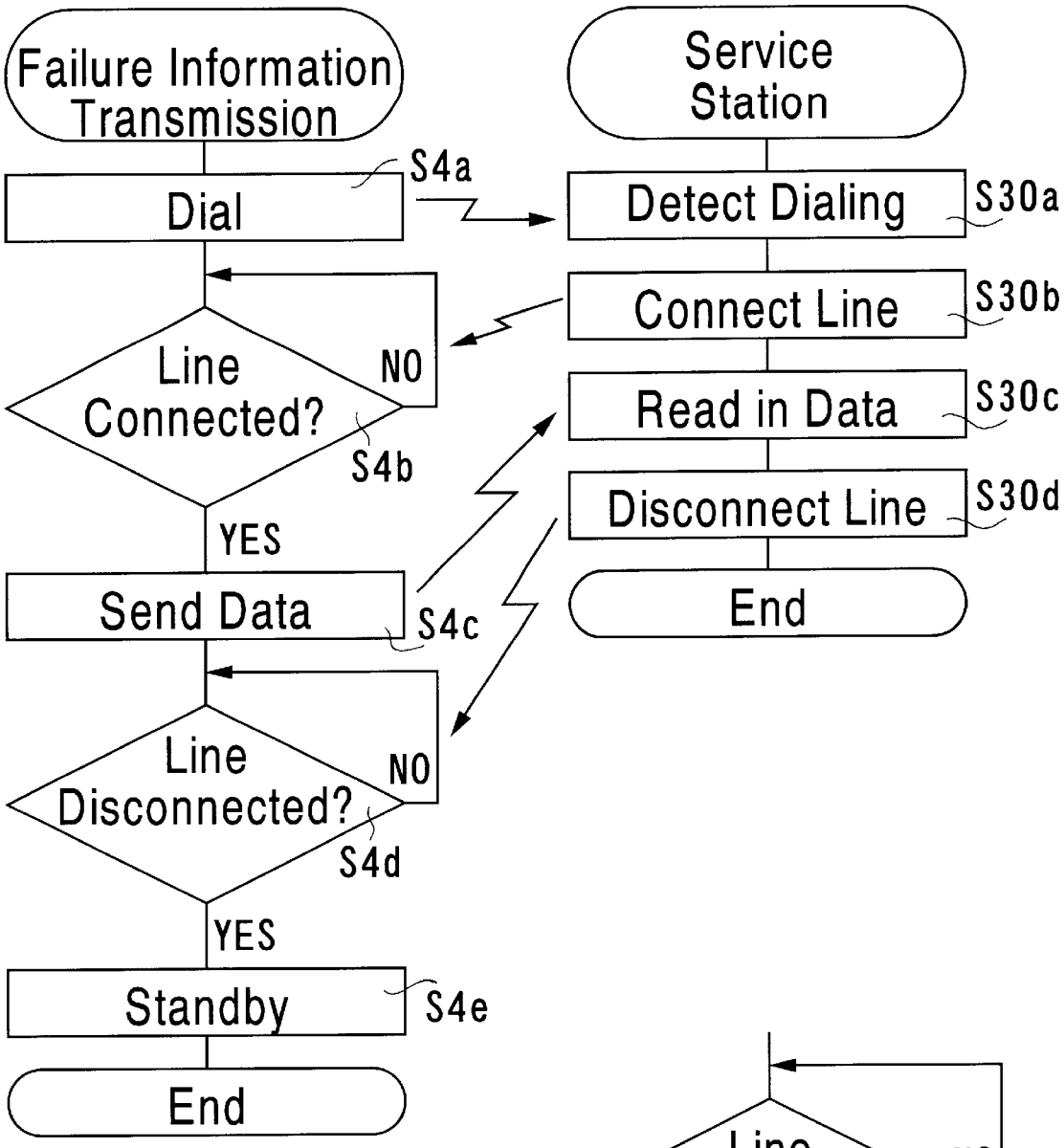
FIG. 4A and FIG. 4B show a flow chart of a failure information transmitting operation of the control unit and a flow chart of a failure information receiving operation of a terminal device at a maintenance station.

FIG. 4A shows a flow chart of the failure information transmission procedure in Step S4 and procedures the terminal device 32 of the maintenance station 30 performs in response to the received failure information.

In the failure information transmission Step S4, the modem 46 at the maintenance station 30 is dialed (Step S4*a*). The CPU 14 sends a command through the interface circuit 34 and the main interface circuit 36 to the modem 38 to dial the modem 46 at the maintenance station 30. Then, the modem 38 dials the modem 46 through the telephone 40, the public telephone line 42 and the telephone 44.

At the maintenance station 30, the modem 46 detects the dialing from the modem 38 and informs the terminal device 32 of it (Step S30*a*). The terminal device 32 commands the modem 46 to connect with the line, and the modem 46 connects itself with the modem 38 (Step S30*b*).

Figures 5, 9:
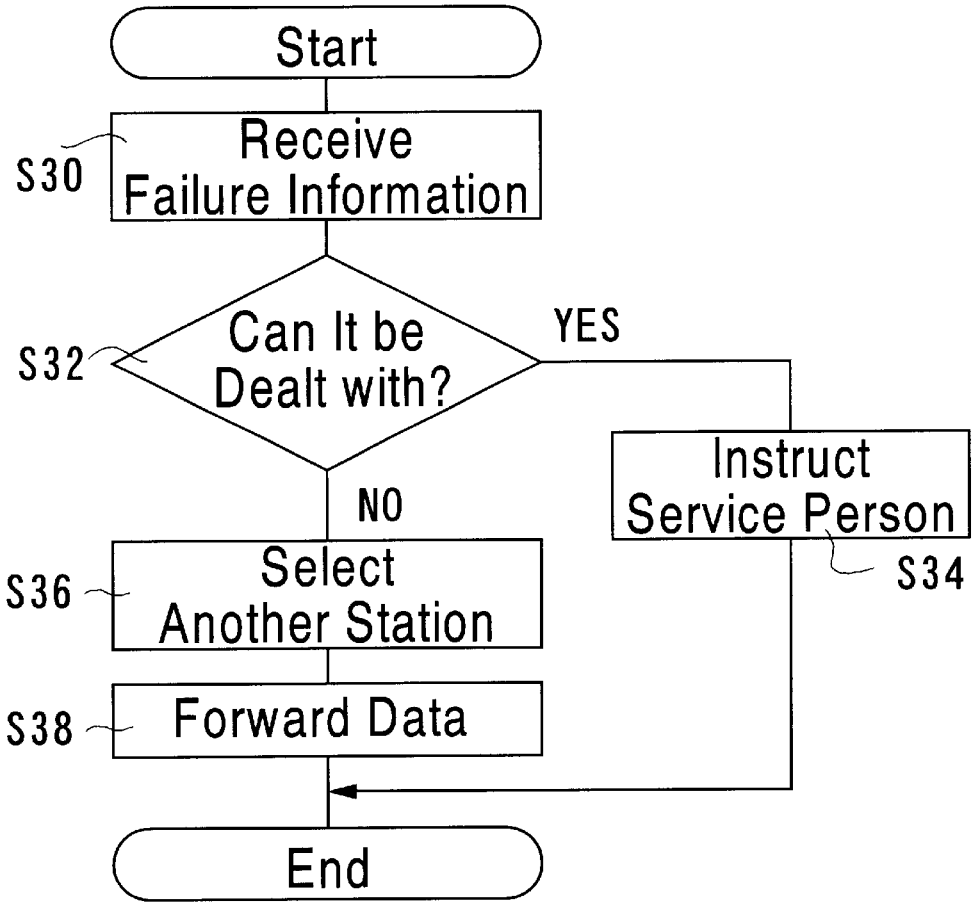
FIG. 5 shows data transmitted in the failure information transmitting operation shown in FIG. 2.
FIG. 9 shows steps taken by a person at a maintenance station according to the embodiment shown in FIG. 7.

After the processing of Step S4*a*, the CPU 14 repeatedly makes a judgment as to whether or not the connection has been completed (Step S4*b*). When the connection is completed, transmission of data or failure information starts (Step S4*c*). The failure information to be transmitted contains an ID code, a failure code and a state code, as shown in FIG. 5.

The ID code is a code assigned to each of the door systems 2*a*, 2*b* and 2*c* to individually identify the door systems. The maintenance station 30 can determine the malfunctioning automatic door system from the received ID code.

The failure code is a code representing the respective self-diagnosis made by the CPU 14. The maintenance station 30 can determine the malfunctioning door system parts from the received failure code.

The state code contains information about the operating state of the automatic door when the detected failure occurs. The information can be used at the maintenance station 30 to determine how to service the door. For example, it can be used to determine whether or not the malfunctioning part should be replaced by a new one. Particularly, the state information includes information of the position of the door where it has stopped, values of various operating parameters, maintenance information about the maintenance which has been provided for the automatic door, etc.

The maintenance information contains information as to how many time the door has been opened and closed since the last maintenance, how many time the door has stopped moving due to external causes, such as collision of a human with the door and intrusion of a pebble in the gap between the door bottom and the floor, how many time the maintenance has been provided for the door since its installation, how many times the CPU 14 has been reset due to runaway of the CPU 14, how many times the parameters have been changed due to rising of the motor temperature, etc.

The transmitted data is read into the terminal device 32 at the maintenance station 30 (Step S30*c*). Then, the terminal device 32 sends a command to the modem 46 to disconnect from the telephone line, and the modem 46 is disconnected from the modem 38 (Step S30*d*).

After sending the failure information, the CPU 14 repeatedly makes judgment as to whether the telephone line has been disconnected or not (Step S4*d*), and then, places itself in a standby state when the disconnection is completed (Step S4*e*). As a result, the door is maintained in an unmovable state, in which it has been placed in Step S12. The door is kept unmovable until a maintenance man finishes repairs of the malfunctioning part.

Figure 4B:
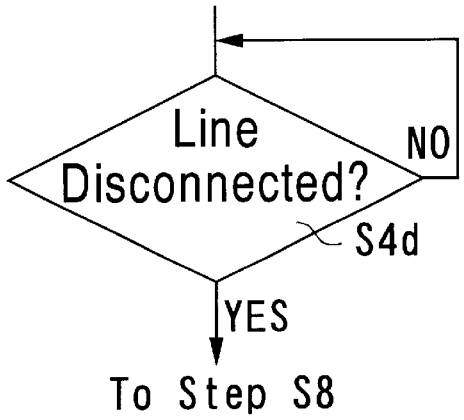

Transmission of failure information done in Step S26 is generally the same as the processing described with reference to FIG. 4A. It is, however, slightly different, as shown in FIG. 4B, in that if it is judged that the line is disconnected in Step S4*d,* the processing does not enter into the standby state of Step S4*e,* but it advances to perform the main routine in Step S8. The failure information sent in Step S26 is to inform that the motor 6 generates heat in an abnormal way. In this case, a parameter has been changed in Step S24 so that the automatic door can continue to operate. This is the reason why the processing does not advance to Step S4*e,* but returns to Step S8.

In the automatic door monitoring system of the described embodiment, the control units 8 of the automatic door systems change parameters and/or stop the door from moving.

According to a second embodiment, the terminal device 32 is arranged to change operating conditions of the door, such as changing operating parameters of the door and/or stopping the door.

Figure 6A:
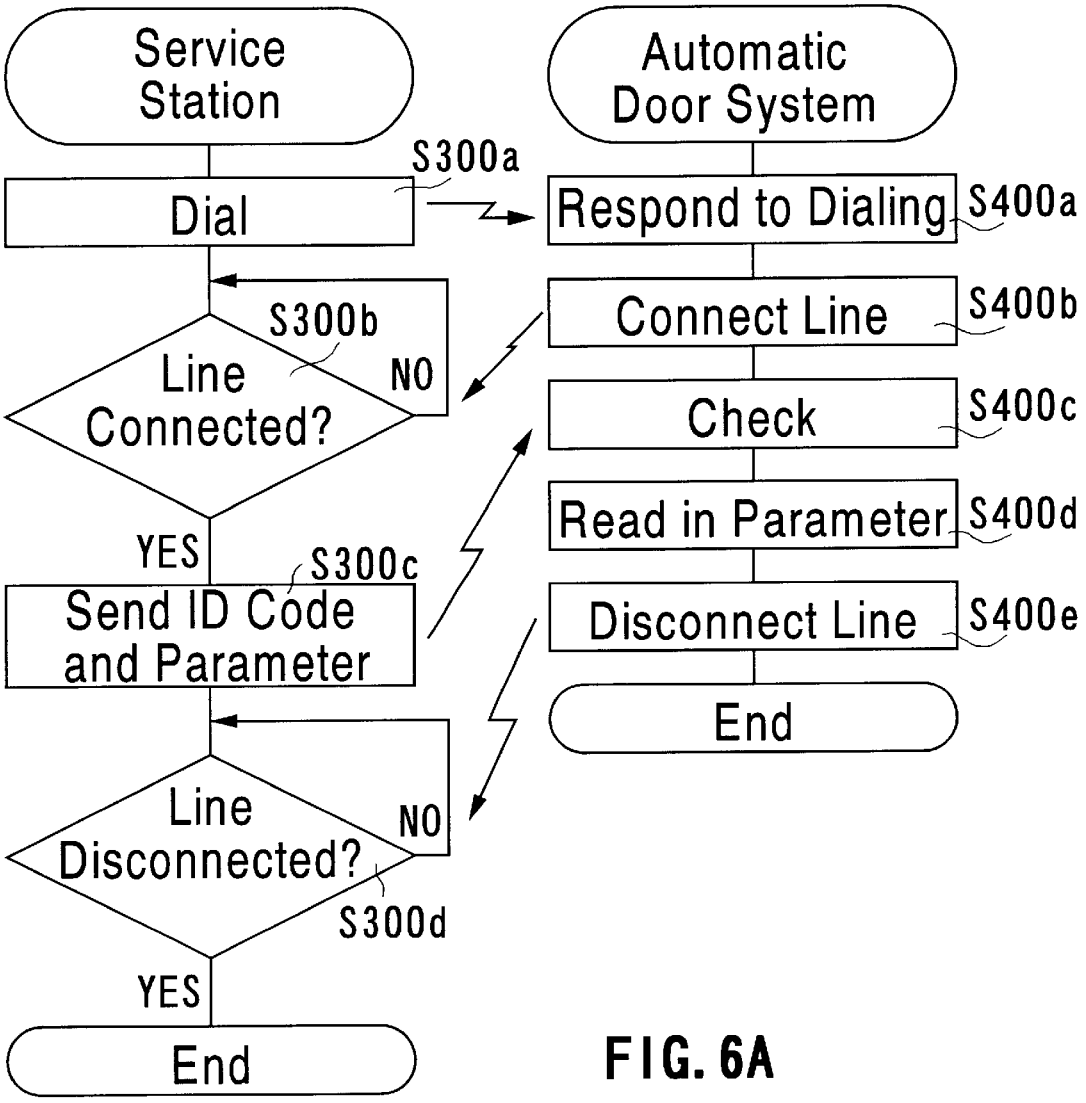
FIG. 6A and FIG. 6B show flow charts of the operation of an automatic door remote monitoring system according to a second embodiment of the present invention.
Figure 6B:
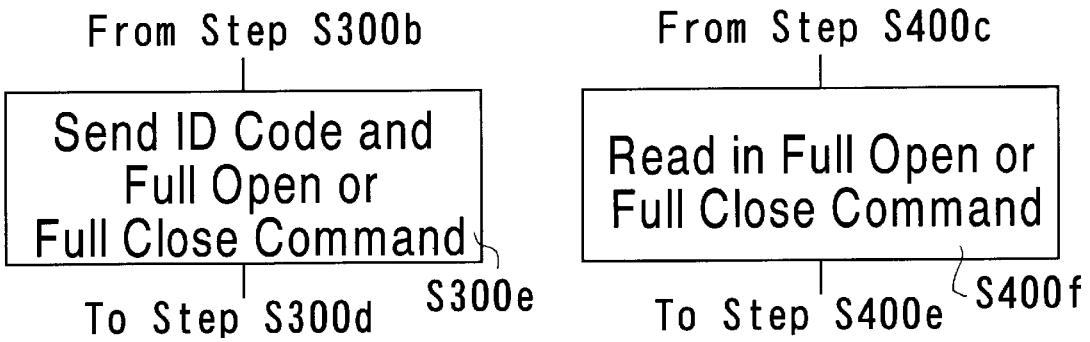

When the terminal device 32 is arranged to, for example, change the door moving parameter, the failure information is sent to the maintenance station 30 in Step S26, and the processing in Step S24 in the flow chart shown in FIG. 3 is omitted. Instead, as shown in FIG. 6A, the maintenance station 30 sends a new parameter etc. to the automatic door system which has sent the failure information.

The terminal device 32 of the maintenance station 30 dials the automatic door system from which the failure information is received (Step S300*a*), and waits for the line connection (Step S300*b*). The automatic door system which has sent the failure information responds to the dialing from the terminal device 32 of the maintenance station (Step S400*a*) and connects the telephone line (Step S400*b*).

When the line is connected, the terminal device 32 sends the ID code of the automatic door system which has sent the failure information and also a new parameter (Step S300*c*) and awaits the disconnection of the line (Step S300*d*). When the line is disconnected, the processing at the maintenance station ends.

At the automatic door system which has sent the failure information, whether or not the transmitted and received ID code is the ID code assigned to that automatic door system (Step S400*c*). If it is, the transmitted new parameter is read in (Step S400*d*), and the line is disconnected (Step S400*e*). After that, the automatic door system operates in accordance with the read-in new parameter.

With the described arrangement of the second embodiment, in which the parameter or parameters are arranged to be sent from the maintenance station 30, a parameter suitable for solving the current problem of the automatic door system can be chosen by the maintenance man at the maintenance station, by considering the content of the information sent in the state code from the automatic door system.

In order for the maintenance station 30 to be able to stop the door from moving, the processing of Step S12 in the flow chart shown in FIG. 3 is omitted, and the failure information transmission is performed in Step S4. After that, the processing shown in FIG. 6A, with Steps S300*c* and S400*d* replaced respectively by Steps S300*e* and S400*f* shown in FIG. 4B, is performed.

A command, i.e. full open or full close command, to fully open or fully close the door is sent from the maintenance station 30 to the automatic door system which sent the failure information to the maintenance station 30, so that the door of the automatic door system is fully opened or fully closed. Whether the door should be fully opened or fully closed is determined by the maintenance man at the maintenance station 30 in accordance with the content of the received state code, e.g. the position at which the failure has detected. Seeing the door staying in the fully opened or closed position, people near the door can readily know that the automatic door system is malfunctioning.

Figure 7:
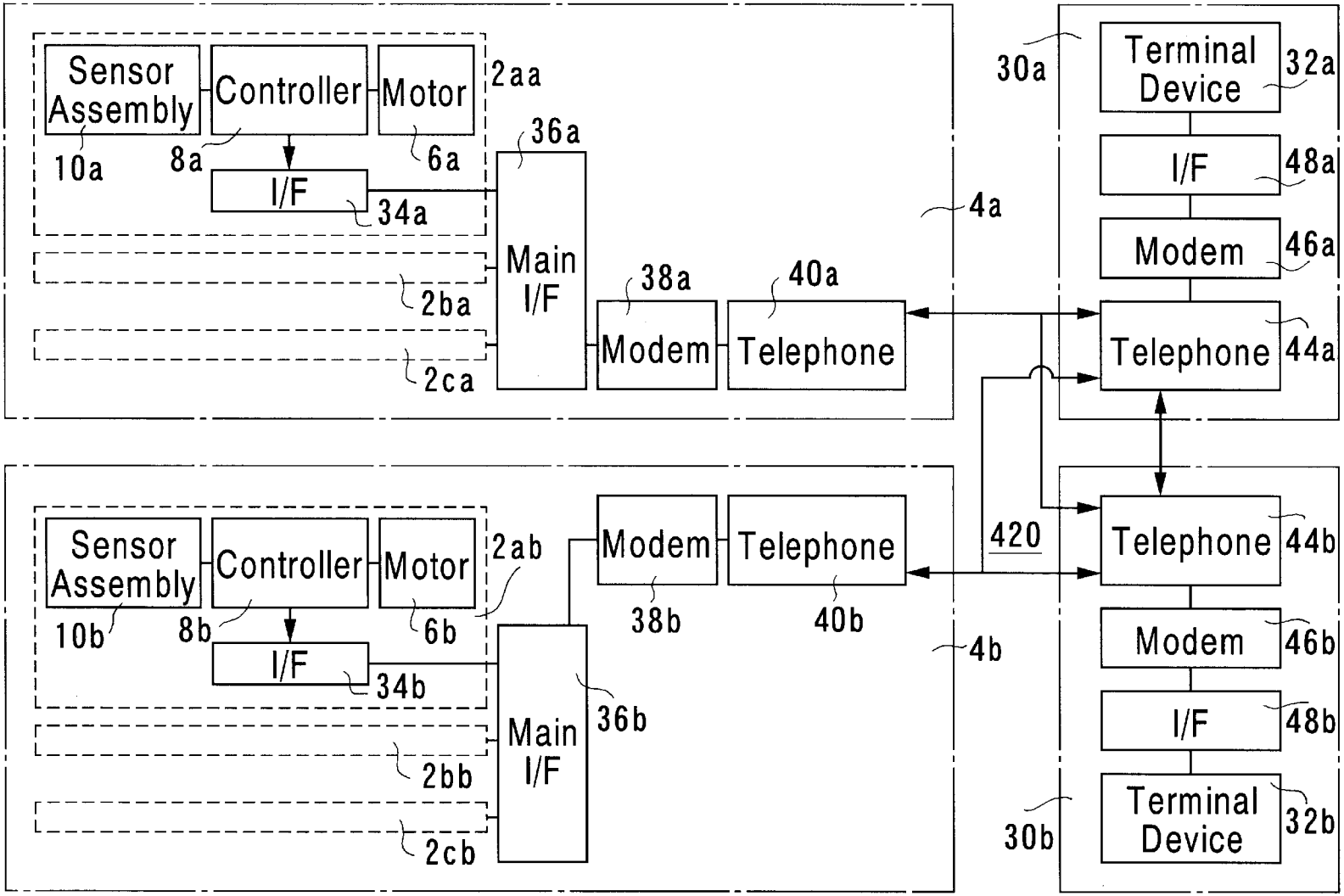
FIG. 7 is a block diagram of an automatic door remote monitoring system according to a third embodiment of the present invention.

In the automatic door monitoring system according to the above-described first and second embodiments, a plurality of automatic door systems in one building send failure information to one maintenance station 30. According to a third embodiment of the present invention, a plurality of automatic door systems of a plurality of buildings can send failure information to any one of a plurality of maintenance stations. As shown in FIG. 7, a plurality of automatic door systems 2*aa,* 2*ba* and 2*ca* in one building 4*a* and a plurality of automatic door systems 2*ab,* 2*bb* and 2*cb* of another building 4*b* can send failure information to either of maintenance stations 30*a* and 30*b*.

Also, a terminal device 32*a* at the maintenance station 30*a* can forward failure information it has received from any one of the automatic door systems to a terminal device 32*b* at the maintenance station 30*b,* and vice versa.

The door systems 2*aa,* 2*ba,* 2*ca,* 2*ab,* 2*bb* and 2*cb* have a structure like that of the door systems 2*a,* 2*b* and 2*c* shown in FIGS. 1 and 2, and the maintenance stations 30*a* and 30*b* have a structure like that of the maintenance station 30.

Figure 8:
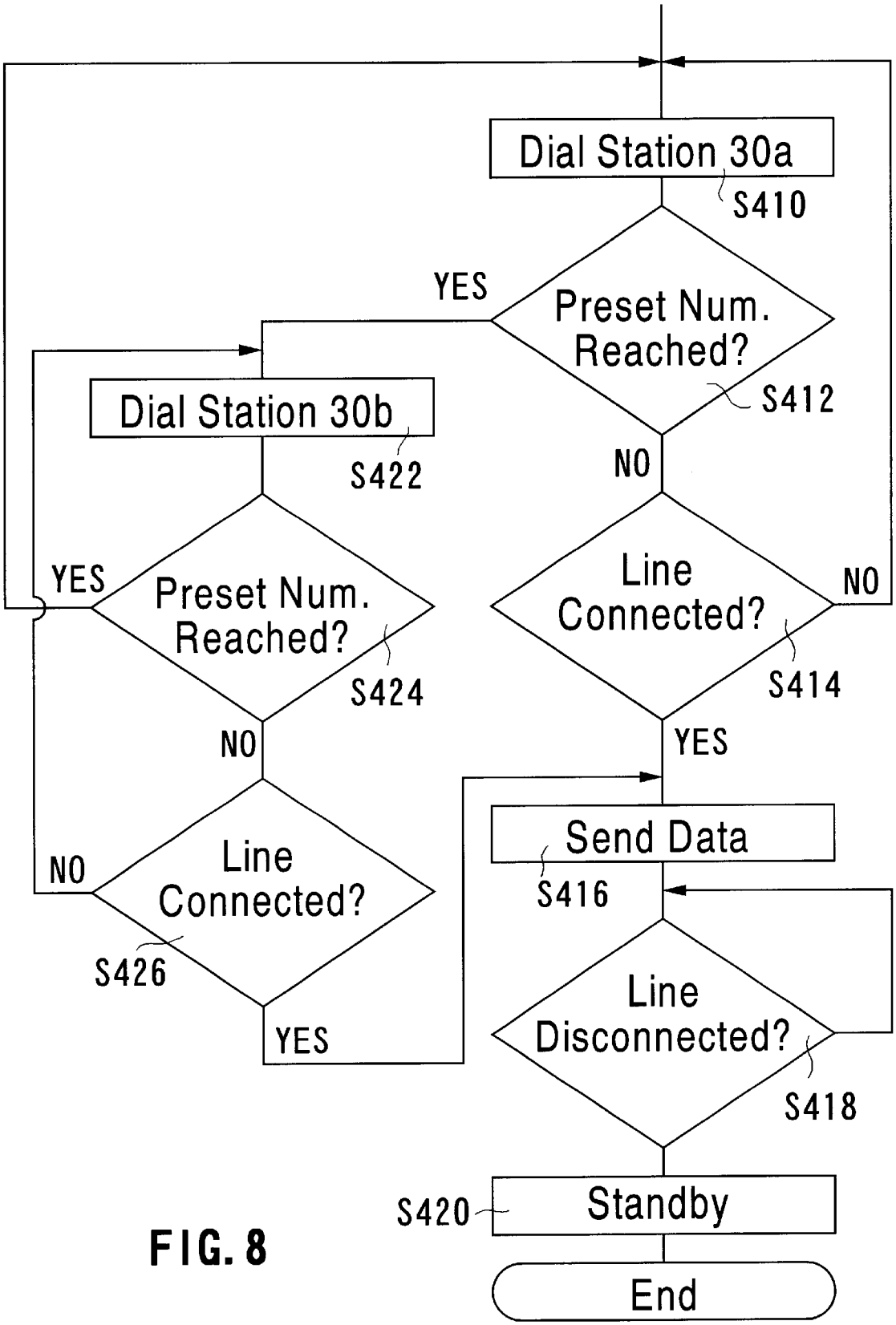
FIG. 8 is a flow chart of failure information transmitting operation of the automatic door remote monitoring system shown in FIG. 7.

FIG. 8 is a flow chart of the processing corresponding to Step S4 in the flow chart shown in FIG. 3, which, for example, one of the automatic door systems in the building 4*a* performs to send failure information to the maintenance station 30*b*. Usually, the automatic door systems of the building 4*a* communicate with the maintenance station 30*a*, but, in the case illustrated in FIG. 8, the maintenance station 30*a* has not been accessible for some reason. For example, the telephone at the maintenance station 30*a* is busy.

First, the maintenance station 30*a* is dialed (Step S410). A judgment as to whether the maintenance station 30*a* has been dialed a predetermined number of time is made (Step S412). If the predetermined number of times of dialing has not been reached yet, a judgment as to whether or not the line is connected is made (Step S414). If the line has not been connected yet, Step S410 is performed again. If it is judged that the line has been connected, the same processing of sending data, judging whether the line is disconnected, and placing the CPU 14 in the standby state, as done in Steps S4*c*, S4*d* and S4*e* shown in FIG. 4A, is performed in Steps S416, S418 and S420.

If the maintenance station 30*a* has been dialed the predetermined number of times, i.e. if the answer to the inquiry made in Step S412 is YES, the maintenance station 30*b* is dialed (Step S422). Then, a judgment is made as to whether or not the maintenance station 30*b* has been dialed a predetermined number of times (Step S424). If the maintenance station 30*b* has not yet been dialed the predetermined number of times, a judgment is made as to whether or not the line is connected (Step S426). If the line has been connected, Steps S416, S418 and S420 are executed. If the line has not yet been connected, Step S422 is executed. When the maintenance station 30*b* has been dialed the predetermined number of times, i.e. if the answer to the inquiry made in Step S424 is YES, Step S410 is executed. In this way, the maintenance stations 30*a* and 30*b* are repeatedly accessed until the automatic door system can communicate with either one of them.

As described above, if an automatic door system cannot connect to a maintenance station which it used to communicate with, it can send failure information to another maintenance station. Thus, it is possible to send a maintenance man at that maintenance station to the automatic door system which has sent failure information. Thus, the automatic door system can be repaired quickly.

The processing corresponding to Step S26 in the flow chart shown in FIG. 3, which is performed in the automatic door systems in the building 4*a*, does not include Step S420 of FIG. 8, and Step S8 for the main routine is executed after step S418. In the processing corresponding to Step S4 and S26 in the flow chart shown in FIG. 3, which is performed in the automatic door systems in the building 4*b*, the maintenance station 30*b* is dialed in Step S410, and the maintenance station 30*a* is dialed in Step S422.

When the maintenance station 30*a*, for example, receives failure information from an automatic door system in the building 4*a*, a member of the service staff at the maintenance station 30*a* acts in accordance with the flow chart shown in FIG. 9. When the station 30*a* receives failure information (Step S30), it is studied by the staff member at the maintenance station 30*a* to judge whether or not the failure can be dealt with the maintenance station 30*a* (Step S32). He makes this judgment, considering whether or not a maintenance man is available at the station 30*a*, and whether or not the part to be replaced for the part which he thinks may be malfunctioning is available at the station 30*a*, together with other factors. If the staff member judges that the failure can be dealt with by the station 30*a*, he chooses the maintenance man to be sent for the repair, gives the maintenance man necessary information including the identification of the door system which has failed, what failure has occurred, how it has occurred, and what parts should be taken with him, and send the maintenance man to the building 4*a* (Step S34).

On the other hand, if the staff member judges that the failure cannot be dealt with by the maintenance station 30*a*, he chooses another maintenance station to which the failure information should be forwarded (Step S36). Though only the maintenance stations 30*a* and 30*b* are shown in FIG. 7, there may be other maintenance stations. All of the maintenance stations may have the same arrangement as the maintenance station 30 shown in FIG. 1. The staff member at the maintenance station 30*a* selects one of such maintenance stations that he thinks is suitable to restore the malfunctioning door system. Then, the staff member operates a terminal device 32*a* to forward the failure information to the selected maintenance station (Step S38). Assuming that the maintenance station 30*b* has been selected. The failure information received at the maintenance station 30*a* is sent via an interface circuit 48*a*, a modem 46*a*, a telephone 44*a*, public telephone lines 420, a telephone 44*b*, a modem 46*b* and an interface circuit 46*b* to a terminal device 32*b* of the maintenance station 30*b*.

The first through third embodiments of the present invention described above are directed to an automatic door remote monitoring system for monitoring remote door systems for failure and for dealing with such failure.

A fourth embodiment of the present invention is directed to a system which makes it possible to change the set operating parameter, e.g. the door moving speed, of the door system without need for sending a maintenance man to the location where the door system is installed. Such change may be done at the request of the building owner who is not satisfied by the preset door moving speed.

Figure 10:
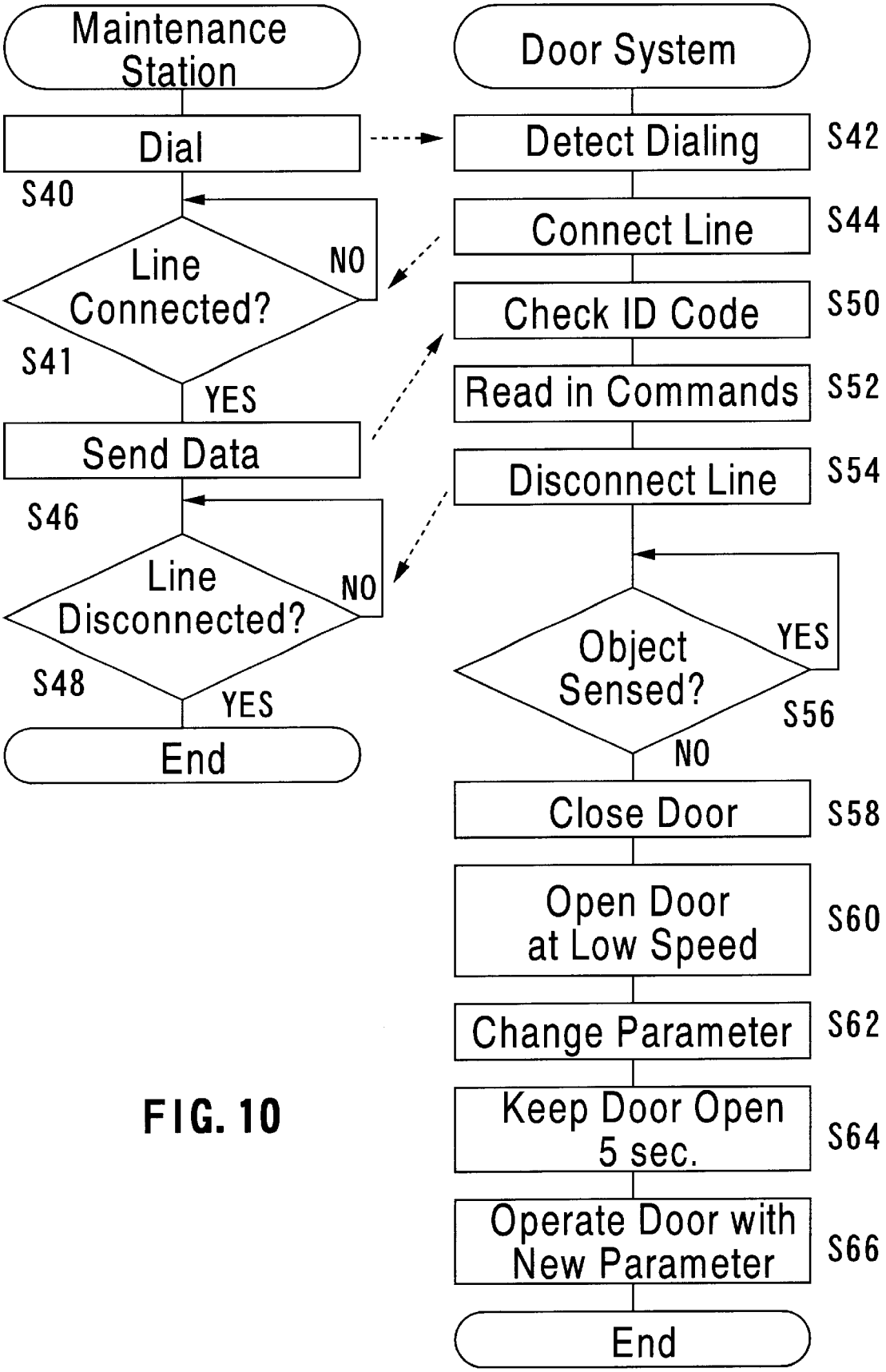
FIG. 10 shows flow charts of operations of an automatic door system and a terminal device of an automatic door remote monitoring system according to a fourth embodiment of the present invention.

The configurations of each automatic door system and each maintenance station are the same as shown in FIGS. 1 and 2, but the programs the CPU 14 of the control unit 8 and the terminal device 32 execute are the ones shown, for example, in FIG. 10. The same reference numerals as used in FIG. 1 are used.

The maintenance station 30 dials, through the modem 46 and the telephone 44, the modem 38 in the building 4 where the automatic door system in question is installed (Step S40) and waits for the connection (Step S41). The modem 38 in the building 4 detects the dialing (Step S42) and connects to the line (Step S44).

The connection to the line is detected in Step S41, and, then, the maintenance station 30 sends data to the automatic door system 30 (Step S46). The maintenance station 30, then, awaits the disconnection from the line (Step S48). The data sent to the automatic door system includes the ID code of the automatic door system of which an operating parameter is to be changed, a new parameter to be replaced, and a command to temporarily operate the door in a predetermined special manner. Such command may, for example, open the door at a low speed and keep it in the open position for five seconds.

The CPU 14 in the control unit 8 for each of the automatic door systems 2*a*, 2*b* and 2*c* in the building 4 determines whether or not the ID code contained in the data sent to it via the modem 38 and the main interface circuit 36 of the building and the interface circuit 34 associated to it is the IC code assigned to that door system (Step S50). The CPU 14 of the automatic door system assigned with the ID code same as the ID code in the data from the maintenance station 30 reads in the command to temporarily operate the door in the special manner as well as the modified parameter (Step S52). Then, the line is disconnected (Step S54). The processing at the maintenance station 30 ends with the disconnection of the line.

After the line is disconnected, a judgment is made in the automatic door side, as to whether or not any one of the sensors in the sensor assembly 10 is sensing an object (Step S56). This step, Step S56, is repeated while an object is being sensed. When the object is no longer sensed by any of the sensors, the CPU 14 causes the automatic door to move to its fully closed position (Step S58). After that, the CPU 14 causes the door to move from the fully closed position to the fully opened position at a speed considerably lower than the preset opening speed (Step S60). The CPU 14 changes the parameter while the door is in the fully opened position (Step S62) and hold the fully opened state of the door for five seconds (Step S64).

Seeing the door move to the fully opened position at a lower speed and stay there as long as five seconds, the building owner can know that the required parameter has been changed. After that, the automatic door operates with the changed parameter (Step S66).

The automatic door remote monitoring system of the present invention is not limited to the above-described embodiments, but various modifications are possible. For example, in place of three-phase brushless motors, DC motors may be used as the motors 6, 6*a* and 6*b*. In the embodiment shown in FIG. 1, three automatic door systems 2*a*, 2*b* and 2*c* send failure information to the maintenance station 30, but it may be arranged that more automatic door systems can send failure information to the station 30. Furthermore, in the embodiment illustrated in FIG. 7, only the automatic door systems installed in the two buildings 4*a* and 4*b* send failure information to the maintenance stations 30*a* and 30*b*, but it may be arranged that automatic door systems in other buildings, too, can send failure information to them. Also, the number of maintenance stations can be larger.

What is claimed is:

1. An automatic door remote monitoring system comprising:

a plurality of automatic door systems each including an automatic door and a control unit, said control unit including door control means for controlling the operation of said automatic door and self-diagnosing means for detecting a failure in components of said automatic door system, said self-diagnosing means, when detecting a failure in any of said components of the automatic door system with which said self-diagnosing means is associated, providing failure information including system identifying information identifying said associated automatic door system, malfunctioning part identifying information identifying a malfunctioning component and system state information about the malfunctioning automatic door; and a communications system for sending said failure information from each of said control units to a maintenance station which monitors and maintains said plurality of automatic door systems;

said maintenance station determining, from said failure information sent thereto, the state of the automatic door of the automatic door system from which said failure information has been sent to said maintenance station, and sending, via said communications system, to the control unit of said automatic door system, a command to change operation of the automatic door of the automatic door system.

2. The automatic door remote monitoring system according to claim 1 wherein said system state information includes door position information about a position of said automatic door when the detected failure has occurred.

3. The automatic door remote monitoring system according to claim 1 wherein said system state information includes operating parameter information about an operating parameter of said automatic door when the detected failure has occurred.

4. The automatic door remote monitoring system according to claim 1 wherein said system state information includes maintenance information about maintenance which was provided for said automatic door system before the detected failure has occurred.

5. An automatic door remote monitoring system comprising:

a plurality of automatic door systems, each including an automatic door and a control unit for controlling said automatic door; and a maintenance station which monitors and maintains said plurality of automatic door systems, said maintenance station sending a command to change an operating parameter of the automatic door of a particular automatic door system via a communications system to the control unit of said particular automatic door system, in accordance with a request by the owner of said particular automatic door system;

said maintenance station, when sending said command to change the operating parameter to said control unit, sending a command to cause said automatic door to temporarily perform a predetermined particular opening and closing operation so as to notify said owner of the operating parameter change;

said control unit of said particular automatic door system causing said automatic door to operate with the operating parameter as changed in response to said command, after causing said automatic door to perform said predetermined particular opening and closing operation.

6. The automatic door remote monitoring system according to claim 5 wherein each of said plurality of automatic door systems includes a sensor for sensing an object approaching the automatic door of that automatic door system, and said control unit of that automatic door system executes the command to change the operating parameter of the automatic door when said control units finds that said sensor is not sensing any object.

7. An automatic door remote monitoring system comprising:

a plurality of automatic door systems each including an automatic door and a control unit, said control unit including door control means for controlling the operation of said automatic door and self-diagnosing means for detecting a failure in components of said automatic door system said self-diagnosing means, when detecting a failure in any of said components of the automatic door system with which said self-diagnosing means is associated, providing failure information including system identifying information identifying said associated automatic door system, and malfunctioning part identifying information identifying a malfunctioning component; and a communications system for sending said failure information from each of said control units to a maintenance station which monitors and maintains said plurality of automatic door systems;

said self-diagnosing means sending said failure information to said maintenance station through said communications system, and also providing a command to change the operation of the automatic door to said door control means, the operation to be changed being dependent on a malfunctioning component of said automatic door.

8. The automatic door remote monitoring system according to claim 7 wherein said command to change the operation of the automatic door is a command to lower the moving sped of said automatic door.

9. The automatic door remote monitoring system according to claim 7 wherein said command to change the operation of the automatic door is a command to move the automatic door to the fully opened or fully closed position thereof.

* * * * *